US006319555B1

(12) United States Patent
Anderson

(10) Patent No.: US 6,319,555 B1
(45) **Date of Patent: *Nov. 20, 2001**

(54) METERING DEVICE FOR PAINT FOR DIGITAL PRINTING

(76) Inventor: Dean Robert Gary Anderson, 1741 North High Country Dr., Orem, UT (US) 84097

( * ) Notice: Subject to any disclaimer, the term of this patent is extended or adjusted under 35 U.S.C. 154(b) by 0 days.

This patent is subject to a terminal disclaimer.

(21) Appl. No.: 09/598,086

(22) Filed: Jun. 21, 2000

Related U.S. Application Data

(62) Division of application No. 08/878,650, filed on Jun. 19, 1997, now Pat. No. 5,972,111.

(51) Int. Cl.[7] ..... B05D 5/00
(52) U.S. Cl. ..... 427/256; 427/348; 101/492
(58) Field of Search ..... 427/348, 349, 427/377, 378, 421, 424, 434.6, 256; 118/63, 304; 101/492

(56) References Cited

U.S. PATENT DOCUMENTS

| | | | |
|---|---|---|---|
| 1,277,632 | 9/1918 | Mizener . | |
| 2,248,713 | 7/1941 | Locke . | |
| 2,346,186 | 4/1944 | Poesl . | |
| 3,082,119 | 3/1963 | Harris . | |
| 3,779,206 | 12/1973 | Sato et al. . | |
| 3,805,737 | 4/1974 | Miller et al. . | |
| 3,977,842 | 8/1976 | Mayhew . | |
| 4,128,668 | 12/1978 | Ernest . | |
| 4,294,408 | 10/1981 | Snyder et al. . | |
| 4,314,263 | 2/1982 | Carley . | |
| 4,324,366 | 4/1982 | Geier et al. . | |
| 4,387,124 | 6/1983 | Pipkin . | |
| 4,489,758 | 12/1984 | Malarz et al. . | |
| 4,527,712 | 7/1985 | Cobbs, Jr. et al. . | |
| 4,528,935 | 7/1985 | Patil et al. . | |
| 4,585,148 | 4/1986 | Ito . | |
| 4,590,857 | 5/1986 | Dahlgren . | |
| 4,648,267 | 3/1987 | Seegmiller . | |
| 4,720,801 | 1/1988 | Boll . | |
| 4,723,712 | 2/1988 | Egli et al. . | |
| 4,731,621 | 3/1988 | Hayamizu et al. . | |
| 4,750,009 | 6/1988 | Yoshimura . | |
| 4,764,780 | 8/1988 | Yamamori et al. . | |
| 4,778,642 | 10/1988 | Lee et al. . | |
| 4,913,050 | 4/1990 | Beaver et al. . | |
| 4,957,782 | 9/1990 | Medler et al. . | |
| 5,017,407 | 5/1991 | Robertson . | |
| 5,076,767 | 12/1991 | Desaulniers et al. . | |
| 5,077,653 | 12/1991 | Barlet . | |
| 5,121,143 | 6/1992 | Hayamizu . | |
| 5,389,148 | 2/1995 | Matsunaga . | |
| 5,511,695 | 4/1996 | Chia et al. . | |
| 5,598,973 | 2/1997 | Weston . | |
| 6,089,160 * | 7/2000 | Anderson | 101/483 |
| 6,090,445 * | 7/2000 | Anderson | 427/256 |

OTHER PUBLICATIONS

NUR Advanced Technologies advertisement for Blueboard™ in *Digital Graphic Magazine*, May/Jun. 1997, p. 69.
Paasche AB (Fine Art) Airbrush instructions, reprinted courtesy of *Airbrush Digest*, 1983.

* cited by examiner

*Primary Examiner*—Brian K. Talbot
(74) *Attorney, Agent, or Firm*—Morriss, Bateman, O'Bryant & Compagni

(57) ABSTRACT

A paint injector for digital printing in which paint is deposited in metered amounts on a print medium comprises a wheel rotatable by a shaft of a motor, an idler disposed in a paint reservoir, and an endless cable disposed around the wheel and the idler. The motor is preferably computer controlled such that the rotation of the wheel and thus movement of the cable is selectively controlled. As the wheel is rotated, paint contained within the paint reservoir coats the cable and is thus drawn by the cable in front of an air stream. The air stream pulls the paint from the cable and carries it toward the print medium. By employing a plurality of such paint injectors into a single print head, each containing a different color of paint, and secured to a computer controlled, movable carriage positioned over the print medium, a digital image can be painted by the print head on the print medium.

26 Claims, 5 Drawing Sheets

METERING DEVICE FOR PAINT FOR DIGITAL PRINTING

This application is a division of Ser. No. 08/878,650 filed Jun. 19, 1997 now U.S. Pat. No. 5,972,111.

BACKGROUND

1. Field of the Invention

This invention relates generally to an apparatus used for digital painting and, more specifically, to an apparatus that employs a metering device for metering a quantity of paint to be deposited on a surface to be painted and that deposits the metered quantity of paint on the surface.

2. Background of the Invention

As computer technology has advanced, the ability to view high resolution graphics has improved and the resolution and speed capabilities of color printers have increased to enable reproduction of photorealistic images. One of the more significant and lucrative printer technologies to be developed in recent years is the ink jet printer that mixes several colors, typically cyan, magenta, yellow and black, on the paper to form a color image. Conventional ink jet printing heads include a plurality of nozzles and thermal elements. Ink is expelled from the nozzles in a jet by bubble pressure created by heating the ink by the thermal elements while the nozzles and thermal elements are in close proximity. One such ink jet printing head, as described in U.S. Pat. No. 5,121,143 to Hayamizu, includes a thermal head member having at least one thermal element consisting of a plurality of thermal dot elements and a plurality of electrodes of different widths connected to each thermal element whereby different widths of heated portions of the thermal element are obtainable to vary the amount of ink jetted in one dot. Another such ink jet printing head is described in U.S. Pat. No. 4,731,621 to Hayamizu et al.

Another type of print head is disclosed in U.S. Pat. No. 4,764,780 to Yamamori et al. in which an ink ejection recording apparatus includes a plurality of ink ejection heads connected to an ink tank, each of the ink ejection heads having an ink nozzle through which minute ink droplets are discharged in accordance with an electric signal and an air nozzle opposing the ink nozzle and adapted for forming an air stream which accelerates the ink droplets toward a recording medium.

Typical desk top ink jet printers for home or office use are relatively inexpensive but are usually limited to printing on standard office size sheets of paper, such as 8 ½×11 or similar standard sizes. Printers that can accommodate larger formats such as poster-sized sheets, however, are currently thousands of dollars to purchase and machines that can print billboard-sized sheets are typically tens of thousands of dollars.

Some wide format printers are able to accommodate 16 feet or wider substrates such as films, paper, vinyl, and the like and can print 300 $ft^2$ per hour, depending on the resolution of the print. Such machines sometimes employ piezo printhead technology that employs several printheads per color with numerous nozzles per printhead to deposit ink onto the print medium. Another approach is to employ air brush technology in which inks are metered by valves and/or pumps and deposited onto the substrate. The quantity of ink pumped for each color and the position at which it is deposited on the print medium is typically computer controlled. The print medium is typically provided on a roll in which un marked medium is fed under the print head and printed medium is re-rolled once the ink has had sufficient time to dry. Large format printers using air brush technology typically have a resolution of up to approximately 70 dpi.

In addition to the cost of the machine itself, which employs relatively small orifices, valves and nozzles for depositing the desired quantity and color of ink on the print medium (e.g., paper), very fine grade inks are used in which particle sizes within the inks are kept to a minimum to help keep the orifices, valves, and nozzles of the ink system from becoming clogged. Such inks are expensive and are not very cost effective for painting billboard sized prints. Despite the high quality and expense of ink products, clogging of the printhead is still a problem in current printer technologies.

Many large format printers also use water-based inks that may not be suitable for outdoor use. Accordingly, special waterproofing systems and techniques must be employed such as treating the printing medium with a substance that binds with the ink once deposited to form a waterproof mark or laminating the print with a weatherproof film. These weatherproofing techniques and processes add expense to the cost of each print.

Thus, it would be advantageous to provide a paint injector or print head that does not include orifices and/or nozzles through which the ink or paint must flow and, thus, is not limited by paint particle size or large particle contamination and is relatively insensitive to the physical properties of the paint. It would also be advantageous to provide a device that can use paints and inks already designed for the sign and art industries and that can be employed to digitally print on large format media.

SUMMARY OF THE INVENTION

It is an object of the present invention to provide a paint injector that can print with many forms of liquid printing materials such as paints and inks.

It is another object of the present invention to provide a paint injector that is relatively simple in construction and relatively inexpensive to manufacture.

It is yet another object of the present invention to provide a paint injector in which the liquid printing material is metered through computer control.

It is still another object of the present invention to provide a plurality of paint injectors in a print head, each paint injector containing a different color, and employing the print head to create a digital image on a print medium.

Accordingly, a paint injector is provided comprising an air nozzle that directs a jet of air across a moving member, the member having ink, paint, or other similarly pigmented liquid material disposed thereon. The air jet pulls the paint off of the member and onto a print medium, such as paper, vinyl, film, or other print media known in the art. Preferably, the segment is a continuous loop of material that is sequentially moved in front of the air jet by at least one wheel around which the loop is disposed. Thus, as the loop is advanced in front of the air jet, paint thereon is blown off of the loop and onto the print medium.

In a preferred embodiment, a miniature wire cable is employed to bring ink or paint contained within a reservoir in proximity with an air stream where it is carried to a print medium. A microprocessor or other controlling device controls the cable so that the speed of the cable's advance through the air stream meters the quantity of paint injected into the air stream. As the cable is advanced through the reservoir, a coating of paint clings to the cable, the thickness of the coating being controlled to a degree by the viscosity of the paint. In addition, a mechanical metering device, such as a scraper riding proximate to or in contact with the cable as it is advanced, may be employed to control the thickness of paint on the cable before it enters the air stream. The cable, having a coating of paint thereon, is then drawn into close proximity to one or more jets of air. As the paint on the cable reaches the jet of air it is pulled or blown off the cable into the air stream until it impacts the print medium. In order to keep the cable positioned in front of the air stream, a cable guide may be employed proximate to the air nozzle to prevent the cable from being forced away from the air stream and to reduce vibration of the cable in the air stream.

The cable is preferably drawn through the paint reservoir and thus coated with paint by being disposed around a pulley or wheel driven by a motor and around an idler or guide that is at least partially immersed in paint. A controller, such as microprocessor or other computing device, controls the advance of the motor and thus movement of the cable. In addition, the controller can control movement of the paint injector as it is swept across a print medium. By utilizing a plurality of paint injectors in a print head, each containing a different color of paint, and by controlling and coordinating the metering of the paint and the position of the print head, a digital image can be created on the print medium.

DETAILED DESCRIPTION OF THE PREFERRED EMBODIMENTS OF THE PRESENT INVENTION

Figure 1:
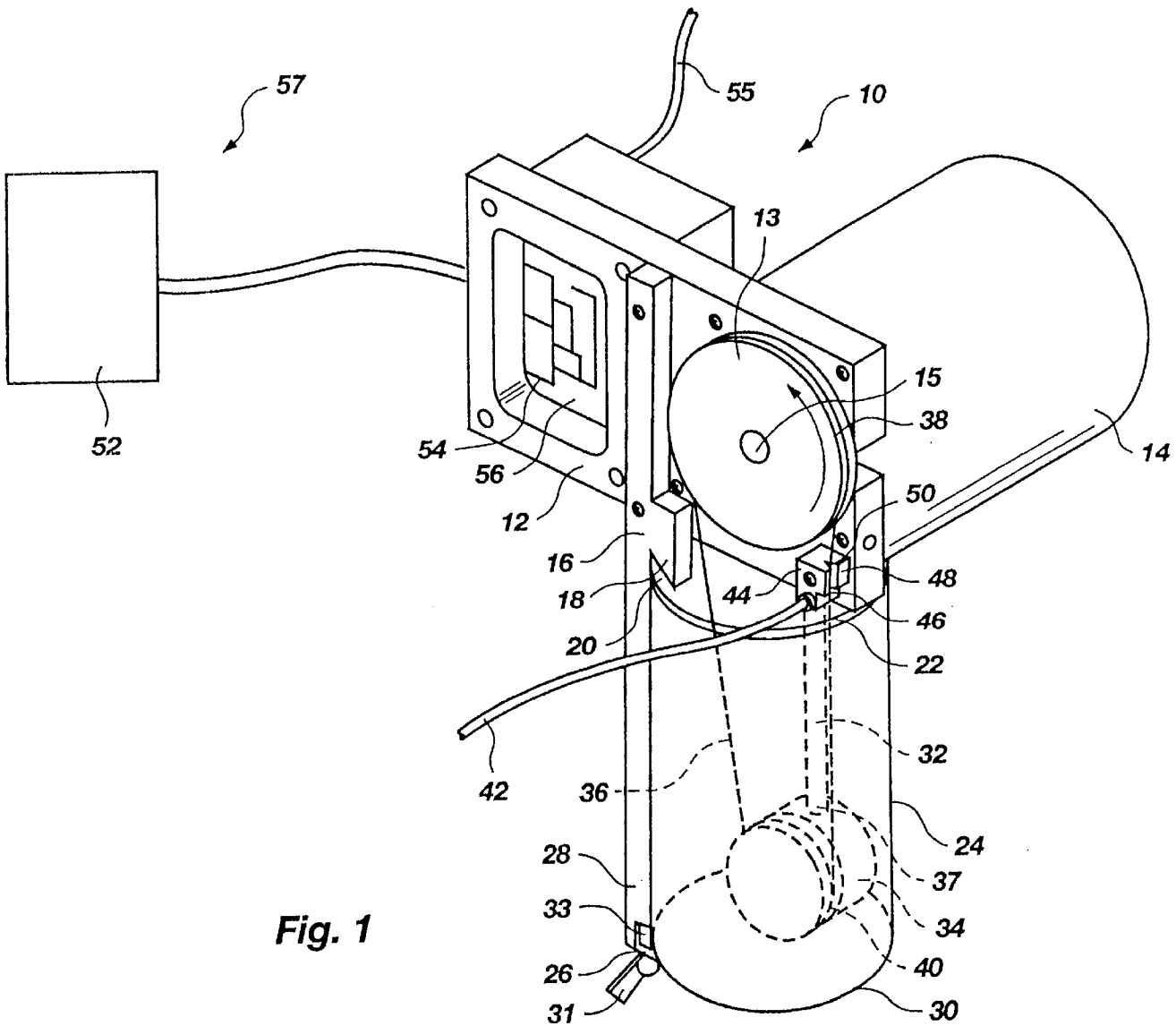
FIG. 1 is a perspective view of a first preferred embodiment of a paint injector in accordance with the present invention.

FIG. 1 illustrates a preferred embodiment of a single color paint injector, generally indicated at 10, according to the present invention for depositing paint, ink, dye, or other liquified pigmented material that could be used for painting or printing onto a substrate comprising a frame or plate 12 to which a motor 14 is attached. The motor may be a stepper motor, a DC motor, or other device known in the art in which rotational advancement can be selectively controlled. A pulley or wheel 13 having a circumscribing groove 38 defined therein is secured to the shaft 15 of the motor 14. An elongate frame member 32 depends from and is secured to the plate 12 and extends into a container 24. A rotatable or stationary idler or guide 34 is attached to the distal end 37 of the elongate frame member 32. The idler or guide 34 may comprise a rotatable wheel or pulley but, as illustrated, may be a cylindrical, non-rotatable member having a groove 40 circumscribing the guide 34 in which a structure or an elongate segment of material, in this example an endless miniature wire cable 36, can slide upon rotation of the wheel 13. It is also contemplated that the segment of material could be comprised of a wire hoop, a band, a ribbon, or a relatively thin structure having material windable from a freely rotatable idler, spool or wheel onto a drive spool or wheel, or any other structure upon which liquified pigmented material could be applied. Preferably, the miniature wire cable 36 is comprised of a plurality of small wires (e.g., three, four, or seven) each having a diameter of between approximately 0.001 and 0.004 inches for example, and may be formed from a single wire spirally wrapped upon itself into the desired overall endless loop diameter. Thus, the wire would spiral around the endless loop a desired number of times (e.g., seven) with the ends of the wire woven into the center of the cable, trimmed flush, and, if desired, welded, as by laser welding, within the cable. Preferably, the overall cable cross-section diameter is approximately 0.012 inches. It is also preferable that the cable be coated with a flexible polyurethane or other similar plastic coating.

The cable 36 is disposed in the groove 38 circumscribing the wheel 13 and in the groove 40 circumscribing the guide 34. The cable may be comprised of a metal material such as stainless steel, spring metal, nickel/titanium alloy, and/or other metals and alloys or of such materials as kevlar, graphite, nylon or other materials that have a substantially high tensile strength. Preferably, the cable 36 is wrapped 1.5 or more times around the wheel 13 and approximately 0.5 times around the guide 34. Wrapping the cable 36 in such a manner around the wheel 13 provides sufficient friction between the wheel 13 and the cable 36 that the cable 36 will not slip relative to the wheel 13. When mounting the cable 36 onto the wheel 13, it is preferably that the cable 36 be placed in the groove 38 so that the end of the wire (as previously discussed) forming the last loop of the cable 36 is not "peeled back" as it rotates around the wheel 13 to be snagged by the top wrap of the cable 36.

Tension in the cable 36 is maintained in a desired range by adjusting the guide 34 relative to the wheel 13. Such tension, however, may be quite minimal as the stiffness and spring-like properties of the material from which the cable 36 is formed helps to maintain tension in the cable 36 and its position relative to the rest of the paint injector 10. A biased second wheel or pulley around which the cable 36 is disposed may also be employed to provide adequate tension in the cable 36.

An elongate reservoir retaining member 16 is attached to the plate 12 and includes a flange 18 depending therefrom defining a notch 20 between the flange 18 and the elongate reservoir retaining member 16 for receiving a top lip 22 of the paint reservoir or container 24. A bottom plate 26 is secured to the distal end 28 of the elongate reservoir retaining member 16 with a threaded nut 31 threaded onto a threaded shaft 33. The threaded shaft 33 is secured to the distal end 28 of the elongate reservoir retaining member 16. The bottom plate 26 abuts against the bottom 30 of the container 24 and holds the container 24 relative to the plate 12 between the flange 18 and the bottom plate 26. Other configurations of reservoirs and containers and means of attaching such containers relative to the plate 12 are also contemplated without departing from the spirit of the present invention. In addition, it is also contemplated that a reservoir may not be required if the pigmented material being deposited is dribbled or otherwise applied, as by wiping across a paint soaked pad, to the cable 36.

An air supply hose 42 is secured to a nozzle body 44 and supplies air through a nozzle orifice 46. The nozzle orifice 46 is aimed at the segment or the cable 36 passing thereby. A cable guide 48 defining a longitudinal slot 50 is positioned proximate the nozzle orifice 46. The cable 36 rides within the slot 50 and is thus held in relative position to the nozzle orifice 46 so that air passing therethrough does not substantially move the cable 36 from in front of the nozzle orifice 46 or cause the cable 36 to substantially vibrate.

Figure 1A:
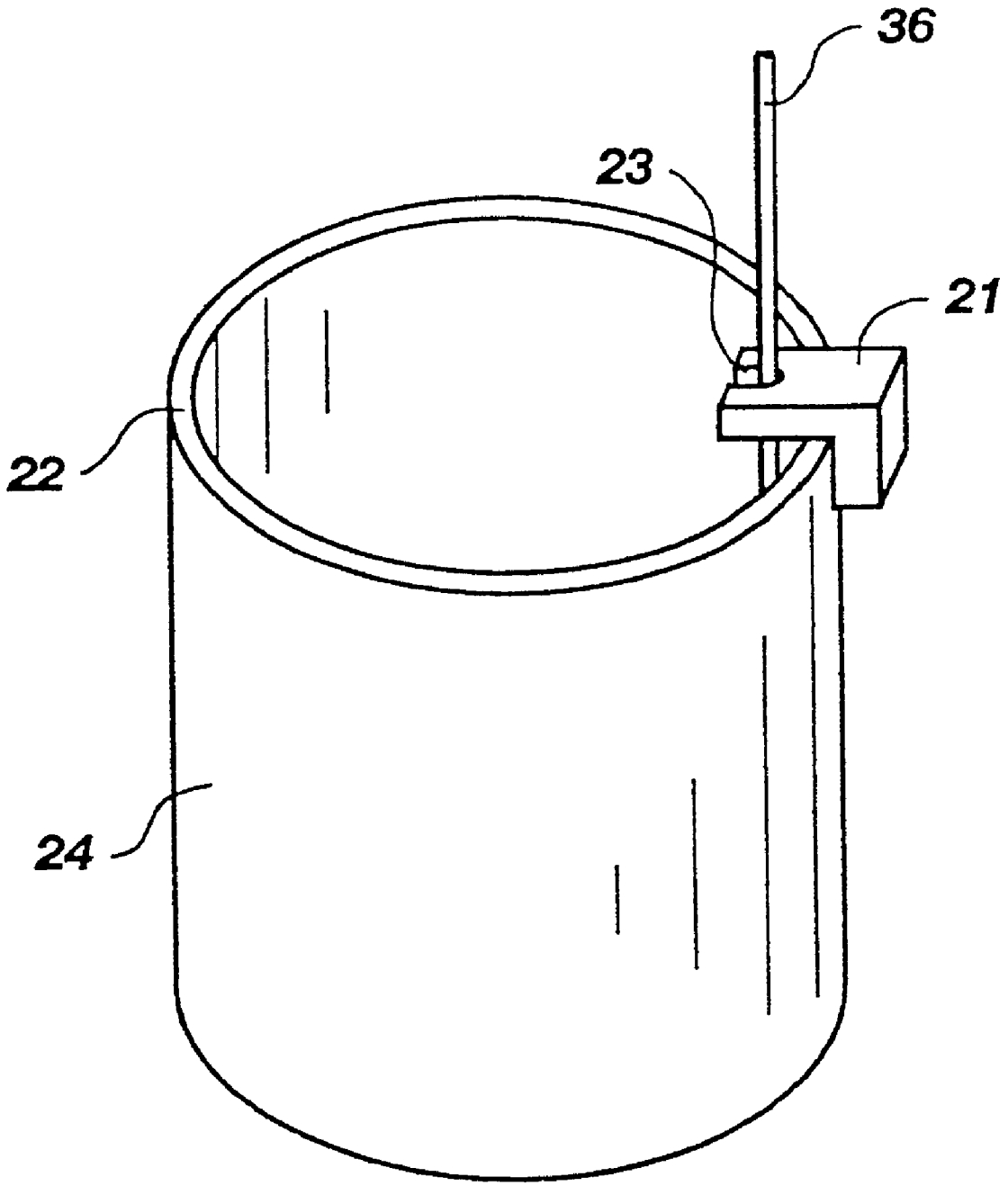
FIG. 1A is a perspective view of the container illustrated in FIG. 1 including a scraping device in accordance with the present invention.

In operation, paint or other pigmented liquid material contained in the container 24 is picked up by the cable 36 and advanced by rotation of the wheel. 13, indicated by the arrow, in front of the nozzle orifice 46. In order to help control the speed of rotation of the wheel 13, a series of gears, wheels, belts, or combinations thereof may be employed between the shaft 15 of the motor 14 and the wheel 13. Air being blown through the nozzle orifice 46 disperses or pulls paint from the cable 36 toward the painting surface. Depending on the viscosity of the paint, the cross-sectional diameter of the cable 36, and the diameter of the wheel 13 formed by the groove 38, a relatively precise amount of paint can be effectively metered by advancing the motor 14 and thus rotating the shaft 15 a relatively precise fraction of a rotation. Such an apparatus may produce images having a resolution of approximately 50 dpi or better, which is more than adequate for large signs such as billboards and the like. In addition, as shown in FIG. 1A, a mechanical metering device such as scraper 21 may be secured to the top lip 22 of the container 24. The scraper 21 may define a slot 23 therein for receiving the cable 36 and thus removing, by wiping or scraping, paint from the cable 36 upon advancement of the cable 36 through the slot 23. The force of the air stream upon the cable 36 removes the paint in such a manner as to produce a relatively clean cable 36 for engagement with the wheel 13. Thus, the cable 36 can rotate about the wheel 13 without the groove 38 becoming obstructed with paint. While an air stream has been described as the preferred vehicle for transporting the paint from the cable 36 to a print medium, it is also contemplated that other fluid streams, such as thinner or other materials known in the art, may be employed or mixed with air or another gas to transport the paint from the cable 36 to a print medium.

Rotation of the shaft 15 is controlled by a controller, generally indicated at 57, comprising circuitry 54 in a module 56 that receives signals from a signal generating device 52, such as a personal computer employing a microprocessor or other devices that can supply discrete signals to instruct selective rotation of the shaft 15 of the motor. The circuitry 54 receives a signal(s) from the device 52 and rotates the shaft 15 of the motor according to the signal(s). Those skilled in the art will recognize that such circuitry 54 could be incorporated into the device 52 or that the components of the device 52 could be incorporated into the module 56. In the case where the motor 14 is a stepper motor, the signal(s) is sent in the form of an electrical pulse(s), each pulse designating a single step that the shaft 15 of the stepper motor 14 is to be rotated. A typical stepper motor provides 200 steps per revolution with each step being activated by a voltage in the range of 0.2 to 5 volts, depending on the voltage requirement of the motor. Thus, if it is desired to deposit the quantity of paint drawn by the cable 36 in one half of a revolution of the wheel 13, 100 pulses would be sent by the device 52, the circuitry 54 would convert each pulse into a voltage depending on the voltage requirement of the stepper motor 14 sufficient to cause the stepper motor 14 to rotate its shaft 15 one step, and the shaft would rotate 100 steps. A power supply line 55 may be provided to the module 56 to provide the requisite voltage to turn the shaft 15 of the motor 14. A preferred way of driving the motor 14 is to perform all shaft 15 advances for the paint injector 10 by time calculations made by the device 52 thereby eliminating the need of a calculating device within the paint injector 10 itself. Thus, all cable 36 advances for the same color of paint, in addition to spatial motions of the paint injector 10 relative to the print medium for depositing the metered paint at relatively precise locations, can be made by the device 52 driving logic lines connected to the module 56 driving the motor 14. If a DC servo motor is employed, the signal sent from the device 52 would be converted into a voltage by the module 56 necessary to rotate the shaft of the DC motor a desired portion of a rotation, and a feedback device, such as an optical encoder, would be employed by the circuitry 54 to control the precise rotation. It is also contemplated that a crude metering of paint could be accomplished by simply providing a timed duration of power to a motor without feedback.

Figure 2:
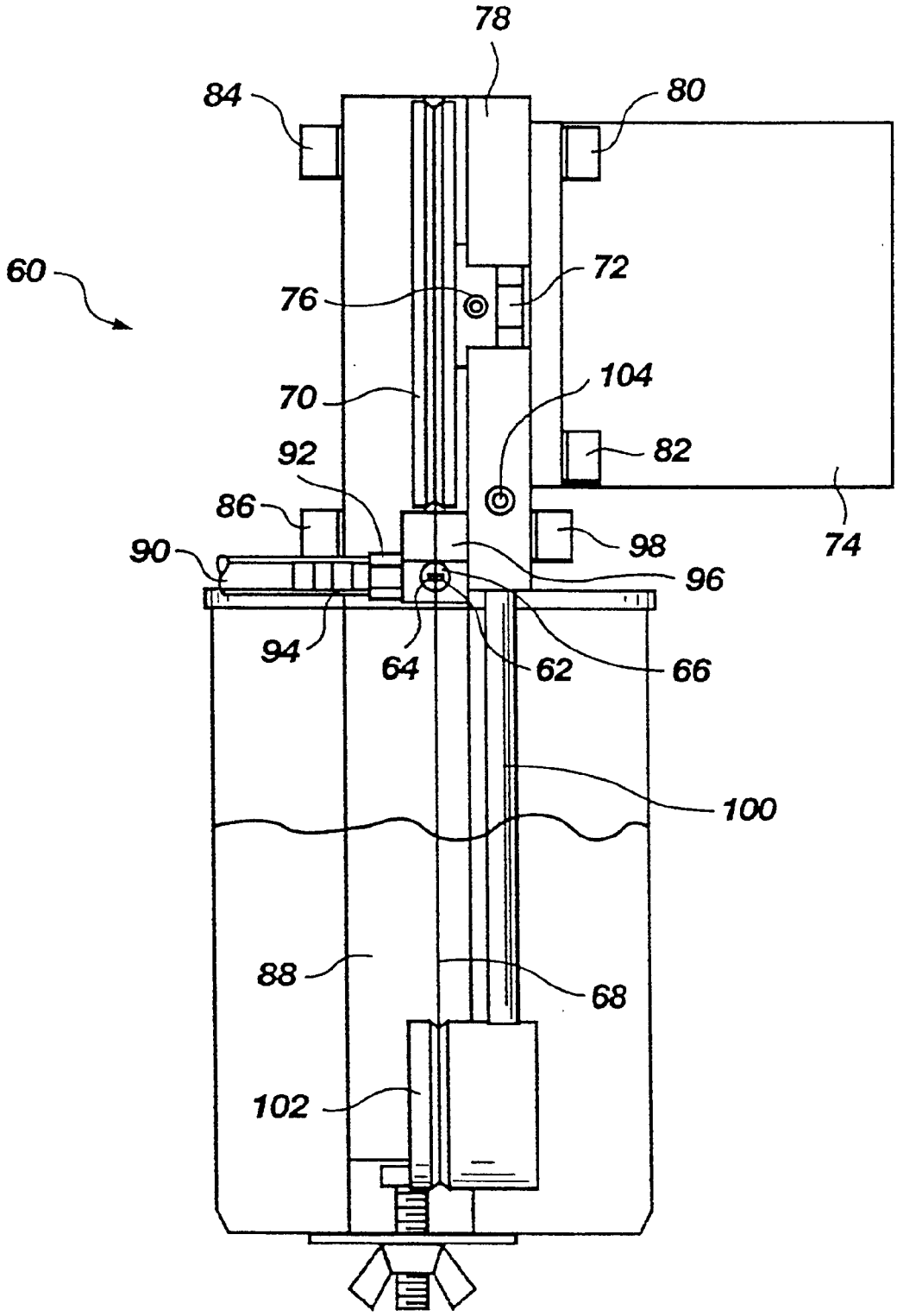
FIG. 2 is a front view of a second preferred embodiment of a paint injector in accordance with the present invention.

Referring to FIG. 2, another preferred embodiment of a paint injector 60 is illustrated. The paint injector 60 includes a nozzle 66 that defines a pair of nozzle ports or orifices 64 and 62. The orifices 64 and 62 are oriented and positioned relative to a cable 68 so that one orifice 64, as viewed in FIG. 2, is positioned on one side of the cable 68 and the other orifice 62 is positioned on the other side of the cable 68.

As further illustrated in FIG. 2, a first wheel 70 is attached to a shaft 72 of a motor 74 with a set screw 76. In addition, the motor 74 is bolted to a plate 78 with bolts such as bolts 80 and 82. Likewise, bolts 84 and 86 attach a reservoir retaining member 88 to the plate 78. An air supply line 90 has a threaded coupling device 92 attached to an end 94 thereof and attaches the supply line 90 to an externally threaded connector (not shown) on the nozzle body 96. The nozzle body 96 is secured to the plate 78 by bolt 98 and an elongate member 100 that supports a guide 102 is secured to the plate 78 by a set screw 104.

Figure 3:
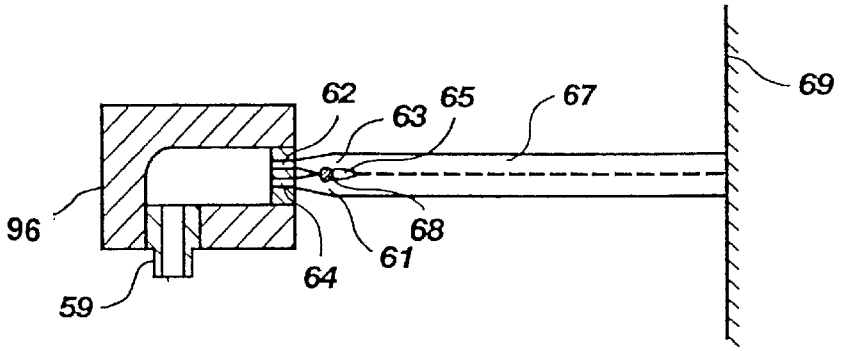
FIG. 3 is a cross-sectional top view of a nozzle body in accordance with the present invention.

The nozzle body 96 is shown in cross-section in FIG. 3 and includes an air supply connector 59 and two orifices 64 and 62 that produce low pressure zones 61 and 63 on both sides of the cable 68 and thus draw the paint 65 from the cable 68 into the air stream 67. The low pressure zones 61 and 63 also help keep the cable 68 centrally located between the two orifices 64 and 62 by providing substantially equal pressure on both sides of the cable 68. Preferably, the orifices 64 and 62 each have a diameter of approximately 0.014 inches and a length of 0.050 inches. While one and two nozzle configurations have been illustrated, various other nozzle configurations may be equally effective for removing the paint 65 from the cable 68 while reducing spray or divergence of the paint within the air stream 67 and are thus contemplated within the scope of the present invention.

Spatter created by the paint 65 impacting the print medium 69 and by turbulent flow of air around the cable 68 may be controlled by controlling the pressure of air supplied to the orifices 64 and 62, and thus the velocity of the air stream 67. For orifices 64 and 62 as described, an air pressure of approximately 10 psi would be sufficient to direct the paint 65 toward the print medium 69 and substantially clean the cable 68 while minimizing spatter. Higher pressures of 80 psi or more may have equal utility depending on the distance of the cable 68 from the paint medium 69, the quantity of paint 65 on the cable 68, and the diameter of the orifices 64 and 62.

Figure 4:
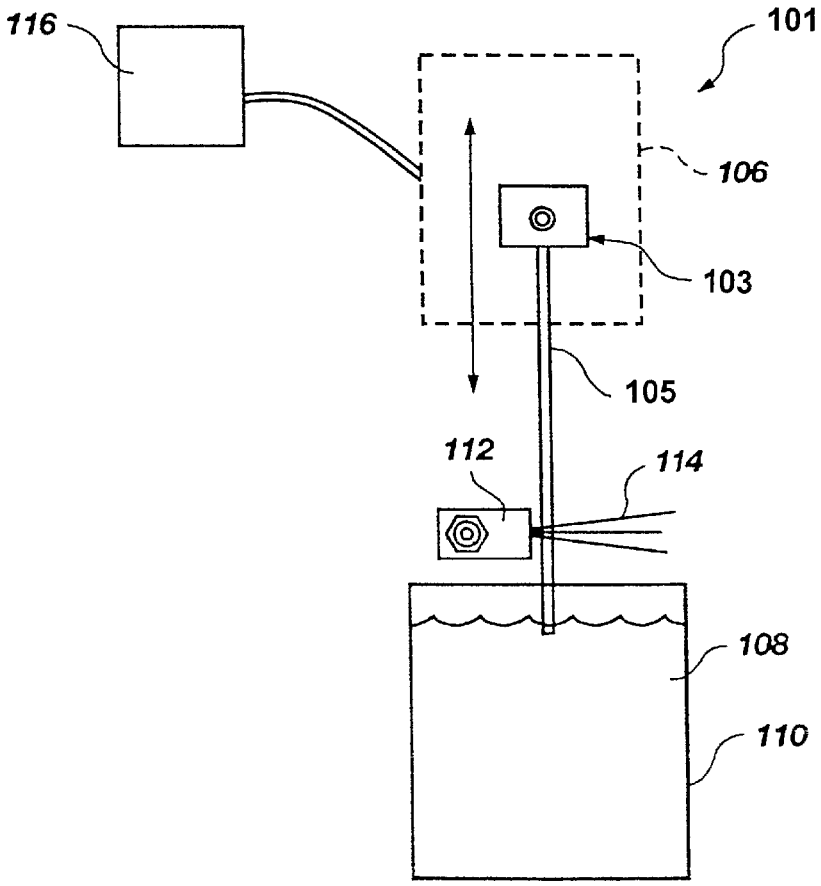
FIG. 4 is a side view of a third embodiment of a paint injector in accordance with the present invention.

While, as previously discussed, a continuous cable of material may be employed to meter the paint, it is equally plausible that other moving devices could be included to provide the same metering effect. For example, as illustrated in FIG. 4, a paint extracting device 103 of a paint injector, 101 may be comprised of an elongate rod 105 attached to structure, generally indicated by dashed line 106, such as a solenoid or other mechanical device such as that found in a typical sewing machine, for moving the elongate rod 105 as indicated by the arrow into and out of the paint 108 contained in a reservoir 110 and in front of the nozzle 112. To meter the paint 108 deposited by the air stream 114, the movement of the rod 105, such as the number of strokes into the paint 108, may be controlled by a controller 116 in a similar manner as previously described with reference to the other preferred embodiments.

Figure 5:
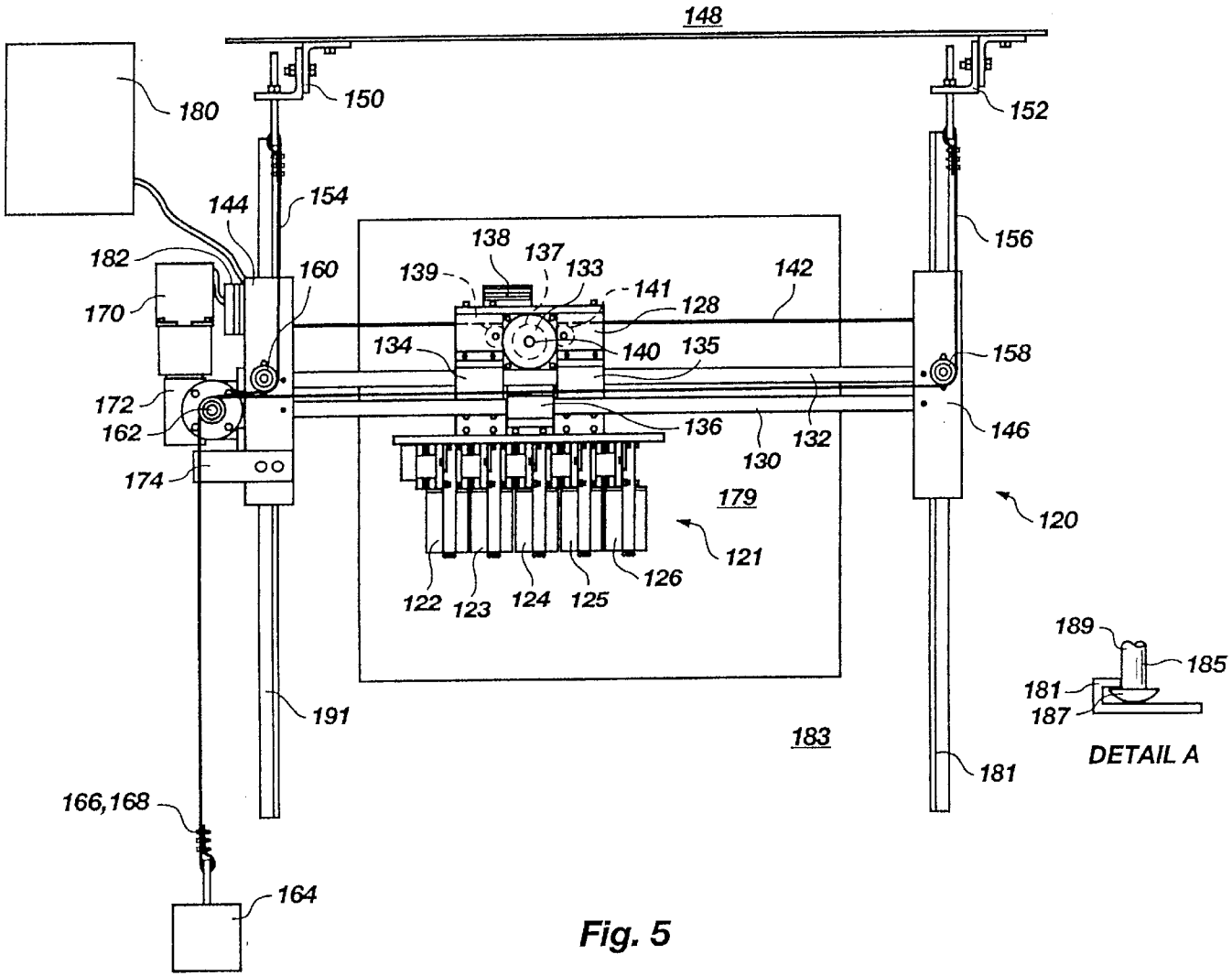
FIG. 5 is a back view of a printing device employing a print head having a plurality of paint injectors in accordance with the present invention.

Referring now to FIG. 5, a digital printing device 120 employing a plurality of paint injectors 122, 123, 124, 125, and 126, such as the paint injectors herein described, attached to a moveable carriage 128. Each paint injector 122, 123, 124, 125, and 126 contains a different color of paint comprising a multi-color print head 121. For example, paint injector 122 may contain yellow, paint injector 123 may contain magenta, paint injector 124 may contain cyan, paint injector 125 may contain black, and paint injector 126 may contain white. Because the print medium is typically white, white paint is not used as a standard color in conventional printheads. Standard process colors include yellow, magenta, cyan, and black. Having white painted added to the mix of colors, however, allows a graphics artist to manually add detail to a wet print without "mudding" the colors or the image. It is also contemplated that more or fewer paint injectors may be included with various colors contained therein depending on the desired colors of print produced.

To selectively move the car rage 128 in an x-direction, the carriage 128 is mounted on a pair of shafts 130 and 132, preferably 1 inch round shafts, with linear bearings 134, 135, and 136 that allow the carriage 128 to slide along the shafts 130 and 132. A motor 133, such as a stepper motor, controlled by x-drive electronics 138 and having a sprocket 137 attached to the shaft 140 thereof is employed to move the carriage 128 along the shafts 130 and 132. The sprocket 137, in conjunction with freely rotatable sprockets or idlers 139 and 141, engages with the drive chain 142 (shown in dashed lines) to move the carriage 128 along the shafts 130 and 132. The drive chain 142 as well as the shafts 130 and 132 are fixed between a left support assembly 144 and a right support assembly 146. It is also contemplated that the motor 133 be mounted on either the left assembly 144 or right assembly 146 or some other structure to lower the mass of the carriage 128. Such a motor would then drive a moveable chain or belt to position the carriage 128 at the desired location.

To selectively move the carriage 128 in a z-direction, the entire printing device 120 is mounted to an overhead structure such as a ceiling 148 with bracket assemblies 150 and 152. The left bracket assembly 150 supports a pair of left z-drive roller chains 154 (only the closest of which is visible) and the right bracket assembly 152 supports a pair of right z-drive roller chains 156 (only the closest of which is visible). A freely rotatable sprocket 158 is mounted to the right assembly 146 and engages one of the right z-drive roller chains 156. Similarly, on the opposite side of the right assembly 146, another freely rotatable sprocket mounted to the right assembly 146 engages the other of the z-drive roller chains 156. Likewise, a freely rotatable sprocket 160 is mounted to the left assembly 144 and engages one of the left z-drive roller chains 154 and another freely rotatable sprocket on the opposite side of the left assembly 144 engages the other of the left z-drive roller chains 154. Both the left z-drive roller chains 154 and the right z-drive roller chains 156 engage with z-drive sprockets 162 (four in all, only the closest of which is visible) and have weights 164, (four in all, only the closest of which is visible) suspended from their distal ends 166 and 168, respectively, to keep the chains 154 and 156 taut around the sprockets 162. Similar to the x-drive assembly, the sprockets 162 are driven by a motor 170, such as a stepper motor, that engages with a worm gear unit 172 as is known in the art to transfer rotational movement of the motor 170 to the sprockets 162 and thus move the left and right assemblies 144 and 146 and thus the carriage 128 in a z-direction. Chain guards, such as chain guard 174, may be utilized near the sprockets 162 to maintain engagement of the chains 154 and 156 with the sprockets 162.

In order to keep the print head 121 from swaying either away from a print medium 179 or from side to side, a track 181 may be vertically oriented and secured to the structure 183, such as a wall or frame, to which the print medium 179 is temporarily secured. As shown in DETAIL A, the track 181 has a J-shaped cross-section into which a guide member 185 can engage and slide therethrough. In this preferred embodiment, the guide member 185 is comprised of a threaded bolt having its head 187 retained by the track 181 and its shaft 189 secured to the right assembly 146. Accordingly, movement of the right assembly 146 is restricted from moving away from the print medium 179 or toward the left assembly 144. Similarly, a second track 191, having an opposite orientation to the track 181, is secured to the structure 183 to restrict movement of the left assembly 144 from moving away from the print medium 179 or toward the right assembly 146. Those skilled in the art will recognize that other track and guide member assemblies could be employed to maintain the printing device 120 in position relative to the print medium 179, such as a single C-shaped track and retaining member arrangement.

In operation, the print medium 179 is positioned in front of the digital painting device 120 and a controller 180, such as a computer, sends signals to the painting device 120 to direct movement of the print head 121 and dispersion of paint from the paint injectors 122, 123, 124, 125, and 126 to form an image on the print medium 179. More specifically, signals from the controller 180 are sent to the z-drive electronics 182 which in urn convert the signals into movement of the sprocket 162 along the chains 154 and 156 corresponding to the desired z-direction position of the print head 121. Likewise, signals from the controller 180 are sent to the x-drive electronics 138 corresponding to the desired x-direction position of the print head 121 along the shafts 130 and 132. The controller 180 also individually controls each of the paint injectors 122, 123, 124, 125, and 126 to deposit the desired color of paint on the print medium 179 at the desired location. Thus, the printable image size of the printing device 120 is only limited by the length of the chains 154, 156, and 142 and the length of the shafts 130 and 132.

The present invention also contemplates that the print head 121, or individual paint injectors 122, 123, 124, 125, and 126 could be employed with other digital printing devices known in the art for digital painting purposes. For example, the print head 121 could be employed in a device where movement of the print head is along an x-axis while a roll of print medium, such as vinyl, is selectively advanced relative to the print head 121 to affect movement along the y- or z-axis. With such a device, the size of print medium may only be limited by the size of the roll of print medium. Likewise, a rigid frame to which the print head, according to the present invention, can be mounted and upon which the print head could be selectively moved could also be employed to allow z- and x-direction movement or x- and y-direction movement of the print head, depending on the orientation of the frame.

In general, the invention comprises digitally controlling the immersion of an extracting device into paint and the advancement of the once immersed and now coated extracting device in front of a stream of air to remove the paint from the extracting device and deposit it onto a print medium. It is noted that while references are made to paint in the specification and claims, the term is intended to encompass, inks, dyes, and any other liquid pigmented material that can be deposited on a surface for printing or painting purposes. In addition, it is to be understood that the above-described embodiments are only illustrative of the application of the principles of the present invention. Numerous modifications and alternatives may be devised by those skilled in the art, including combinations of the various embodiments, without departing from the spirit and scope of the present invention. The appended claims are intended to cover such modifications, alternative arrangements, and combinations.

What is claimed is:

1. A method for digital printing, comprising:

providing a print medium;

providing an air stream;

depositing a pigmented liquid onto an exterior surface of a substantially poreless elongate segment;

directing said air stream at said elongate segment;

electronically controlling advancement of said elongate segment though said air stream to remove a metered amount of said pigmented liquid from the exterior surface of said elongate segment and deposit said pigmented liquid onto said print medium.

2. The method of claim 1, further including electronically controlling the position of the air stream and the elongate segment relative to the print medium.

3. The method of claim 1, wherein said electronically controlling the position includes moving said air stream and said elongate segment in an x and y direction relative to the print medium.

4. The method of claim 1, wherein said depositing includes applying a substantially even layer of pigmented liquid to the exterior of said elongate segment.

5. The method of claim 1, further including providing a plurality of air streams and a plurality of elongate segments.

6. The method of claim 1, further including providing a different color of pigmented liquid to each of said plurality of air streams and each of said plurality of elongate segments.

7. The method of claim 1, further including metering a relatively thin layer of said pigmented liquid on at least a portion of said exterior surface of said elongate segment, removing said relatively thin layer from said exterior surface, and depositing the pigmented liquid contained in said relatively thin layer onto the print medium.

8. The method of claim 1, further including generating said fluid stream from at least two nozzles, each nozzle directing a fluid stream around a different side of said elongate segment.

9. A method of producing an image on a print medium, comprising:

applying a liquid to a substantially poreless strand;

advancing said strand through an air stream to remove an electronically metered amount of said liquid primarily from an exterior surface of said strand and deposit said amount onto the print medium; and electronically controlling the position of said air stream relative to the print medium for depositing said amount of said liquid proximate the position.

10. The method of claim 9 further including electronically controlling advancement of said strand relative to said air stream.

11. The method of claim 9, further including providing a plurality of strands.

12. The method of claim 9, further including providing a different color of liquid for each of said plurality of strands.

13. The method of claim 9, further including metering a relatively thin layer of said liquid on at least on an exterior surface of said strand, passing said air stream around the exterior surface of said strand for removing a metered amount of said relatively thin layer from all surfaces of said strand at the location of interaction between said air stream and said strand, and depositing the liquid contained in said relatively thin layer onto the print medium.

14. The method of claim 9, further including generating said air stream from at least two nozzles, each nozzle directing an air stream around the sides of the strand.

15. A method of digital printing, comprising:

directing an air jet at a wire-shaped member;

providing the wire-shaped member with a coating of paint thereon;

advancing the wire-shaped member and the paint coating provided thereon through the air jet to remove an electronically metered amount of paint from the paint coated portion of the wire-shaped member;

carrying the paint in the air jet toward a surface;

depositing said paint onto said surface.

16. The method of claim 15, further including enveloping a portion of said wire shaped member with said air jet to remove said paint coating therefrom.

17. The method of claim 15, further including controlling the advancement of the wire-shaped member to electronically meter the amount of paint removed from the wire-shaped member.

18. The method of claim 15, further including generating said air jet from at least two nozzles, each nozzle directing a fluid stream around a different side of said wire-shaped member.

19. The method of claim 15, wherein said directing said air jet includes producing a substantially continuous flow of air through a nozzle aimed at and flowing around a portion of said wire-shaped member.

20. A method of digital printing, comprising:

providing at least one paint injector, the at least one paint injector having a wire-shaped member; applying a coating of paint to the wire-shaped member;

advancing the wire-shaped member to apply a coating of paint to the wire-shaped member; and directing a fluid stream at the wire-shaped member; and electronically controlling advancement of a paint coated portion of the wire-shaped member through the fluid stream thereby removing an electronically metered amount of paint from an exterior of the wire-shaped member and depositing it onto a surface.

21. The method of claim 20, further including controlling the position of the at least one paint injector relative to the surface.

22. The method of claim 21, wherein said controlling includes moving said at least one paint injector in an x and y direction relative to the surface.

23. The method of claim 20, further including providing a plurality of paint injectors in a single carriage, each paint injector having a wire-shaped member and a fluid stream, and independently electronically controlling advancement of the paint coated portion of each of the wire-shaped members through their respective fluid stream thereby selectively removing an electronically metered amount of paint from an exterior of each of the wire-shaped members and depositing it onto the surface, each of said plurality of paint injectors provided with a different color of paint.

24. The method of claim 20, further including metering a relatively thin layer of said paint on at least one side of an exterior surface of said wire-shaped member, selectively removing said relatively thin layer from said exterior surface, and depositing the paint contained in said relatively thin layer onto the surface.

25. The method of claim 20, further including generating said fluid stream from at least two nozzles, each directing a fluid stream around the sides of the wire-shaped member.

26. The method of claim 20, wherein said directing said fluid stream includes producing a substantially continuous flow of air through a nozzle aimed at and flowing around a portion of said wire-shaped member.

* * * * *